US006764155B2

(12) United States Patent
D'Souza et al.

(10) Patent No.: US 6,764,155 B2
(45) Date of Patent: Jul. 20, 2004

(54) SYSTEM AND METHOD FOR COMPENSATING FOR NON-FUNCTIONAL INK CARTRIDGE INK JET NOZZLES

(75) Inventors: Henry M. D'Souza, Cypress, TX (US); Curtis L. Crisler, Cypress, TX (US); Gokalp Bayramoglu, Houston, TX (US)

(73) Assignee: Hewlett-Packard Development Company, L.P., Houston, TX (US)

( * ) Notice: Subject to any disclaimer, the term of this patent is extended or adjusted under 35 U.S.C. 154(b) by 0 days.

(21) Appl. No.: 10/238,056

(22) Filed: Sep. 9, 2002

(65) Prior Publication Data

US 2004/0046811 A1 Mar. 11, 2004

(51) Int. Cl.[7] ..... B41J 29/38; B41J 29/393
(52) U.S. Cl. ..... 347/12; 347/19
(58) Field of Search ..... 347/12, 19, 14, 347/23, 7, 13, 29, 35, 9, 42, 86, 5, 15, 37, 85, 87, 30; 358/296

(56) References Cited

U.S. PATENT DOCUMENTS 6,089,693 A * 7/2000 Drake et al. ..... 347/19
6,120,125 A * 9/2000 Kim ..... 347/19

* cited by examiner

*Primary Examiner*—Stephen D. Meier
*Assistant Examiner*—Charles Stewart, Jr.

(57) ABSTRACT

A system for compensating for non-functional ink cartridge ink jet nozzles is provided. The system includes an ink jet compensation system that receives ink jet nozzle failure data, such as each nozzle that is clogged or damaged, and that generates nozzle correction data, such as a nozzle to fire instead of each failed nozzle for a given print pattern or a nozzle firing sequence that compensates for the failed nozzle, such as by printing at that location during a subsequent or previous printer head pass. An ink control system receives the nozzle correction data and image data and generates printer control data, such as by receiving image data in a standard format for printing and modifying the printer control data that would be generated if all ink jet heads were functioning properly to include the nozzle correction data.

12 Claims, 5 Drawing Sheets

052617.1290

052617.1290

052617.1290

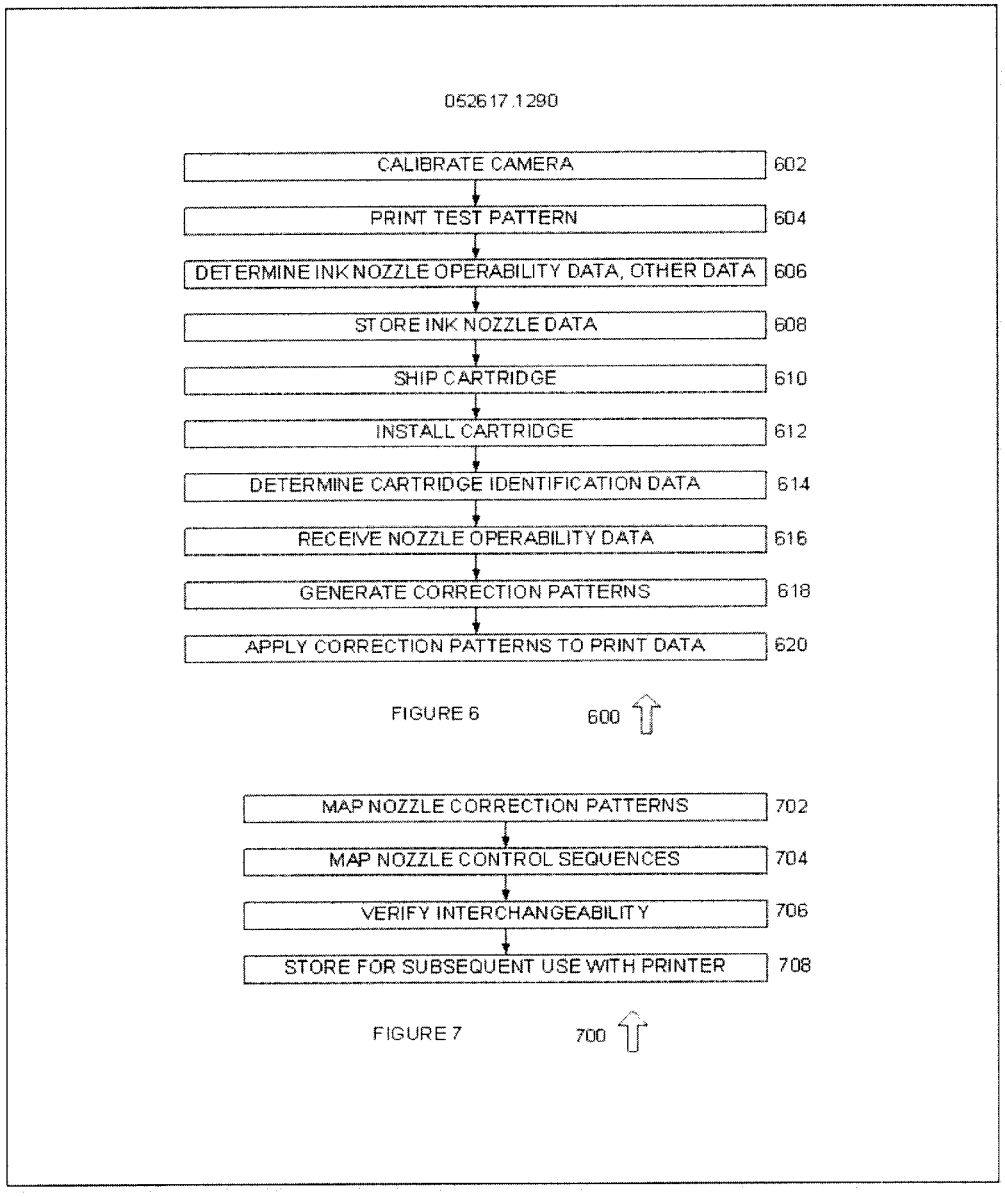
052617.1290
CALIBRATE CAMERA
602
PRINT TEST PATTERN
604
DETERMINE INK NOZZLE OPERABILITY DATA, OTHER DATA
606
STORE INK NOZZLE DATA
608
SHIP CARTRIDGE
610
INSTALL CARTRIDGE
612
DETERMINE CARTRIDGE IDENTIFICATION DATA
614
RECEIVE NOZZLE OPERABILITY DATA
616
GENERATE CORRECTION PATTERNS
618
APPLY CORRECTION PATTERNS TO PRINT DATA
620
FIGURE 6
600
MAP NOZZLE CORRECTION PATTERNS
702
MAP NOZZLE CONTROL SEQUENCES
704
VERIFY INTERCHANGEABILITY
706
STORE FOR SUBSEQUENT USE WITH PRINTER
708
FIGURE 7
700

052617.1290

052617.1290

SYSTEM AND METHOD FOR COMPENSATING FOR NON-FUNCTIONAL INK CARTRIDGE INK JET NOZZLES

CROSS-REFERENCE TO RELATED APPLICATIONS

This application is related to co-pending and commonly owned application Ser. No. 09/822,094, filed Mar. 30, 2001, entitled "Automatic Printer Color Correction Based on Characterization Data of a Color Ink Cartridge;" and to application Ser. No. 10/184,468, filed Jun. 27, 2002, entitled "Method and System for Controlling Printer Color;" and to application Ser. No. 10/185,807, filed Jun. 27, 2002, entitled "Method and System for Characterizing Printer Color," each of which are hereby incorporated by reference in their entirety for all purposes.

STATEMENTS REGARDING FEDERALLY SPONSORED RESEARCH OR DEVELOPMENT

Not applicable.

REFERENCE TO A MICROFICHE APPENDIX

Not applicable.

BACKGROUND OF THE INVENTION

1. Field of the Invention

The present invention generally relates to ink cartridge control and more particularly to determining ink jet nozzle control data for an ink cartridge that can be used to compensate for non-functional ink jet nozzles.

2. Description of the Related Art

An ink jet ink cartridge includes a number of ink jet nozzles that are fired in a predetermined pattern in response to image data to generate an image. The predetermined pattern takes into account that each ink jet nozzle is not fired on every pass, and that the ink jet nozzle array can pass over the same location more than once. The printer driver of a personal computer receives image data in a standard format and generates printer control data based on the number of nozzles in the ink cartridge and other ink cartridge parameters.

If one or more ink jet nozzles of an ink cartridge are non-functional, such as because of damage or clogging, then the image quality generated by that ink cartridge will suffer from level of image quality degradation. This image quality degradation may or may not be noticeable to the human eye. As a result of this image quality degradation, ink cartridge manufacturers and others set levels for an acceptable number and density of non-functional ink jet nozzles for a given ink cartridge. If the number of non-functional ink jet nozzles exceeds this predetermined number, then the ink cartridge is not used, which decreases ink cartridge yield rates and drives up the cost of manufacturing ink cartridges.

SUMMARY OF THE INVENTION

In accordance with the present invention, a system and method for compensating for non-functional ink cartridge ink jet nozzles or other suitable print mechanisms are provided that overcome known problems with non-functional ink jet nozzles.

In particular, a system and method for compensating for non-functional ink cartridge ink jet nozzles are disclosed that use other functional ink jet nozzles of the ink cartridge instead of the non-functional nozzle in order to allow ink cartridges that would otherwise be discarded to be used, thereby increasing ink cartridge yield rates.

In accordance with an exemplary embodiment of the present invention, a system for compensating for non-functional ink cartridge ink jet nozzles is provided. The system includes an ink jet compensation system that receives ink jet nozzle failure data, such as the coordinates of each nozzle that is clogged or damaged, and that generates nozzle correction data, such as a nozzle to fire instead of each failed nozzle for a given print pattern or a nozzle firing sequence that compensates for the failed nozzle, such as by printing at the location of the failed nozzle during a subsequent or previous printer head pass. An ink control system receives the nozzle correction data and image data and generates printer control data, such as by receiving image data in a standard format for printing and modifying the printer control data that would be generated if all ink jet heads were functioning properly to include the nozzle correction data.

The present invention provides many important technical advantages. One important technical advantage is a system for compensating for non-functional ink cartridge ink jet nozzles that uses functional ink jet nozzles to compensate for non-functional ink jet nozzles, such as by firing an adjacent functional nozzle instead of a non-functional nozzle, or by firing a functional nozzle during a previous or subsequent printer head pass so as to print in the location that the non-functional ink jet nozzle would have printed. The present invention thus allows ink jet nozzle failure data for each ink cartridge to be generated and used to compensate for the non-functional ink jet nozzles, thereby increasing ink cartridge yield.

Those skilled in the art will further appreciate the advantages and superior features of the invention together with other important aspects thereof on reading the detailed description that follows in conjunction with the drawings.

BRIEF DESCRIPTION OF THE SEVERAL VIEWS OF THE DRAWINGS

A better understanding of the present invention can be obtained when the following detailed description of the preferred embodiment is considered in conjunction with the following drawings, in which:

FIG. 6 is a flowchart of a method for providing compensation for non-functional ink cartridge ink jet nozzles in accordance with an exemplary embodiment of the present invention;

FIG. 7 is a flowchart of a method for generating nozzle correction pattern data and nozzle control sequence data in accordance with an exemplary embodiment of the present invention;

DETAILED DESCRIPTION OF THE INVENTION

Figure 1:
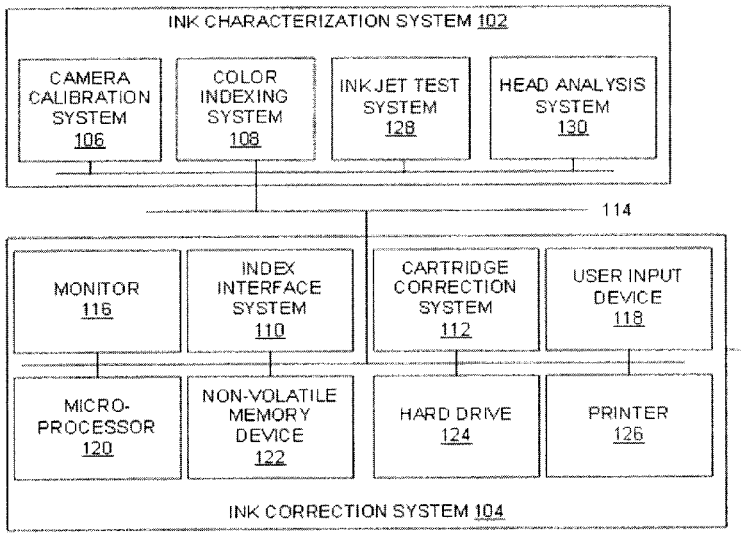
FIG. 1 is a diagram of a system for providing color characterization and color control, including compensation for non-functional ink jet nozzles or other suitable printing mechanisms, in accordance with an exemplary embodiment of the present invention.

In the description that follows, like parts are marked throughout the specification and drawings with the same reference numerals, respectively. The drawing figures might not be to scale and certain components can be shown in generalized or schematic form and identified by commercial designations in the interest of clarity and conciseness.

FIG. 1 is a diagram of a system 100 for providing color characterization and color control, including compensation for non-functional ink jet nozzles or other suitable printing mechanisms, in accordance with an exemplary embodiment of the present invention. System 100 allows the color density generated for a corresponding dot activation for a specimen ink cartridge to be characterized as part of the manufacturing process, such that the color characterization data can be accessed when the cartridge is installed for use, and further maps the specimen ink cartridge data to reference ink cartridge data, so as to generate printer control data that activates the correct dot percentage to generate a desired color density. System 100 can also be used with other suitable methods and systems for generating color density, such as those that do not use dot activation.

System 100 includes ink characterization system 102 and ink correction system 104, each of which can be implemented in hardware, software, or a suitable combination of hardware and software, and which can be one or more hardware systems, or one or more software systems operating on a general purpose processing platform. As used herein, a hardware system can include discrete semiconductor devices, an application-specific integrated circuit, a field programmable gate array or other suitable devices. A software system can include one or more objects, agents, threads, lines of code, subroutines, separate software applications, user-readable (source) code, machine-readable (object) code, two or more lines of code in two or more corresponding software applications, databases, or other suitable software architectures. In one exemplary embodiment, a software system can include one or more lines of code in a general purpose software application, such as an operating system, and one or more lines of code in a specific purpose software application. A software system can be stored on hard drive 124, and retrieved by microprocessor 120 for operation in conjunction with non-volatile memory device 122, user input device 118, printer 126, and monitor 116. In this exemplary embodiment, a software system can include a printer driver, a monitor driver, a camera driver, or other suitable software systems.

Ink characterization system 102 is coupled to ink correction system 104 by communications medium 114. As used herein, the term "couple" and its cognate terms, such as "couples" and "coupled," can include a physical connection (such as a copper conductor), a virtual connection (such as through randomly assigned memory locations of a data memory device), a logical connection (such as through logical gates of a semiconducting device), other suitable connections, or a suitable combination of such connections. In one exemplary embodiment, systems and components are coupled to other systems and components through intervening systems and components, such as through an operating system. Communications medium 114 can be a local area network, a wide area network, a public network such as the Internet, the public switched telephone network, a wireless network, a fiber optic network, other suitable media, or a suitable combination of such media.

Ink characterization system 102 provides ink characterization data to ink correction system 104, such as when a user of ink correction system 104 installs a new cartridge, by storing the ink characterization data on the cartridge, or in other suitable manners. Ink characterization system 102 includes camera calibration system 106, color indexing system 108, ink jet test system 128, and head analysis system 130, each of which can be implemented in hardware, software, or a suitable combination of hardware and software, and which can be one or more software systems operating on a general purpose processing platform.

Camera calibration system 106 is used to calibrate a video camera so that it can be used to provide color characterization data. In the past, calorimeters, spectrophotometers, or other specialized devices were required in order to obtain a precise estimate of the color of printed ink. Camera calibration system 106 performs calibration of video cameras having standard color pixel arrays with pixel filters so that high speed video cameras can be used to perform color characterization.

Color indexing system 108 receives the color characterization data for a specimen ink cartridge and stores it in a relational database so it can be retrieved at a later date. In addition, color indexing system 108 stores reference ink cartridge color characterization data and associated reference ink cartridge identification data with specimen ink cartridge data. In this manner, color indexing system 108 allows reference ink cartridge data and specimen ink cartridge data to be provided on demand, to be stored on a cartridge for transmission to the user, or in other suitable manners.

Ink correction system 104 includes index interface system 110 and cartridge correction system 112, each of which can be implemented in hardware, software, or a suitable combination of hardware and software, and which can be one or more software systems operating on a general purpose processing platform. Index interface system 110 retrieves the specimen ink cartridge color characterization data and the reference ink cartridge color characterization data, such as by contacting color indexing system 108 over communications medium 114, by retrieving the data from a data storage device of the ink cartridge, or in other suitable manners. Index interface system 110 then provides the data to cartridge correction system 112, which generates color correction factors from the specimen ink cartridge color characterization data and the reference ink cartridge color characterization data to be used for controlling printing. Cartridge correction system 112 can also receive other suitable data from ink characterization system 102 for controlling the quality of the color, such as empirical scale factors. In another exemplary embodiment, index interface system 110 retrieves non-functional ink jet nozzle identification data, nozzle correction pattern data, nozzle control sequence data, or other suitable data from ink jet test system 128, head analysis system 130, or other suitable systems, and provides the data to cartridge correction system 112 for use in correcting an ink cartridge for non-functional ink jet nozzles or other conditions.

Ink jet test system 128 performs ink cartridge ink jet nozzle test processes in accordance with an exemplary embodiment of the present invention. Ink jet test system 128 can print two or more ink jet nozzle test patterns that can be subsequently analyzed to determine which, if any, of the ink jet nozzles are non-functional, such as due to clogging, damage, or other problems. In one exemplary embodiment, ink jet test system 128 can generate a sequence of patterns, such as patterns in which alternating rows of nozzles are activated, patterns that are configured to allow image data to be readily analyzed to detect non-functional ink jet nozzles, or other suitable patterns. In another exemplary embodiment, ink jet test system 128 can generate a sequence of nozzle correction patterns and nozzle control sequence images that can be analyzed to determine whether the nozzle correction patterns or nozzle control sequences can be used to compensate for non-functional ink jet nozzles. In this exemplary embodiment, ink jet test system 128 can receive non-functional nozzle identification data and can generate a first sequence of test patterns for activation of the ink cartridge with different ink jet nozzles activated in place of the non-functional ink jet nozzle, such as to allow the patterns to be compared to a reference image for determination of color density similarity, image data similarity, for comparison of image data generated by a camera or other device that simulates the human viewing capabilities, or other suitable tests.

Likewise, ink jet test system 128 can generate a sequence of test images whereby the non-functional ink jet nozzle function is compensated for by firing other ink jet nozzles during a previous or subsequent pass of the printer head. For example, an ink jet printer head typically prints by activating certain nozzles in a forward pass while allowing other nozzles to remain inactive, and by activating the other nozzles in a reverse pass while allowing the forward pass nozzles to remain inactive. In this manner, problems caused by nozzle overheating can be minimized. Likewise, the ink jet head can pass over a given point at least four times, depending on the printing speed and resolution twice in a forward direction and twice in a returning direction. Thus, the point at which a non-functional nozzle should have printed might be accessible by another functional nozzle in a previous or subsequent pass, either in the forward or reverse direction. Ink jet test system 128 generates test images using automatically generated sequences, which are then indexed so that the generated test images can be compared to reference images, so as to select one or more alternate nozzle correction patterns or nozzle control sequences.

Head analysis system 130 receives non-functional ink jet nozzle identification data and selects nozzle correction pattern data and nozzle control sequence data for the ink cartridge. In one exemplary embodiment, an ink cartridge can include one or more non-functional ink jet nozzles, such that the ink cartridge may otherwise need to be discarded if corrective action is not taken to compensate for the non-functional ink jet nozzles. Head analysis system 130 receives non-functional nozzle identification data, nozzle correction pattern data, and nozzle control sequence data, and determines whether a suitable set of nozzle correction pattern data and nozzle control sequence data exists to allow the ink cartridge to be used. In one exemplary embodiment, head analysis system 130 can include a table of allowable configurations for non-functional ink jet nozzles, and can determine based on the non-functional nozzle identification data received for an ink cartridge whether allowable nozzle correction pattern data and nozzle control sequence data exists for the set of non-functional ink jet nozzles. In this manner, head analysis system 130 can increase the production yield of a production run of ink cartridges, by identifying ink cartridges with non-functional ink jet nozzles that can otherwise be used in conjunction with such nozzle correction pattern data and nozzle control sequence data.

Head analysis system 130 can interface with color indexing system 108 or other suitable systems to store the non-functional nozzle identification data for an ink cartridge, such as by storing the nozzle correction pattern data and nozzle control sequence data on a data storage device of ink characterization system 102, on a data storage device of the ink cartridge, by transmitting the data to an ink correction system 104, by transmitting the non-functional nozzle identification data to ink correction system 104, where ink correction system 104 can calculate or retrieve the nozzle correction pattern data and nozzle control sequence data, or using other suitable processes or configurations.

In operation, system 100 can be used as part of a manufacturing process to generate and distribute color characterization data for ink cartridges, to provide nozzle correction patterns or nozzle control sequences that compensate for non-functional ink jet nozzles, or for other suitable purposes. Ink characterization system 102 can be used to develop reference ink cartridge color characterization data and specimen ink cartridge color characterization data for specific cartridges.

Camera calibration system 106 can be used to control the quality and repeatability of image data measurements made by different cameras, so as to perform high speed color density measurement and to avoid the need for expensive special-function devices, such as colorimeters and spectrophotometers.

Color indexing system 108 receives color characterization data for specimen ink cartridges and reference ink cartridges and provides the data on demand, with each cartridge, or in other suitable manners.

Index interface system 110 allows the user to obtain the cartridge correction data, either by querying color indexing system 108 over communications medium 114, by retrieving the reference ink cartridge data and specimen ink cartridge data from a data storage device of the cartridge, or in other suitable manners.

Cartridge correction system 112 uses the reference ink cartridge data and specimen ink cartridge data to determine correction factors for controlling printing. For example, the reference ink cartridge may be used to generate color density levels that are used to comply with standard organizations so as to insure consistent and uniform color of images on printed media, projectors, video screens, or in other suitable applications. Nevertheless, individual ink cartridges may produce non-standardized color density due to ink quality variations, nozzle parameter or functionality variations, or other factors.

System 100 allows ink cartridges to be characterized on a factory floor or in other suitable locations, such as a centralized testing facility, so that the characterization data can be provided to the users for correction of color, so as to ensure that the color of an original image is accurately reproduced. In this manner, the color characterization data for each cartridge can be used to determine whether a correction factor is required, and to generate the correction factor.

Figure 2:
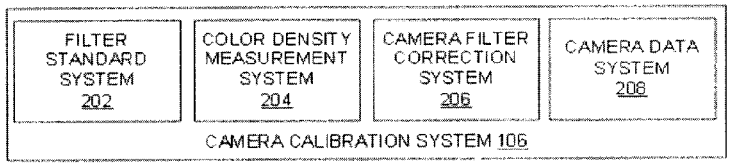
FIG. 2 is a diagram of a system for providing camera calibration in accordance with an exemplary embodiment of the present invention.

FIG. 2 is a diagram of a system 200 for providing camera calibration in accordance with an exemplary embodiment of the present invention. System 200 includes camera calibration system 106 and filter standard system 202, color density measurement system 204, camera filter correction system 206, and camera data system 208, each of which can be implemented in hardware, software, or a suitable combination of hardware and software, and which can be one or more software systems operating on a general purpose processing platform.

Filter standard system 202 stores and provides standard density data in accordance with one or more standards. In one exemplary embodiment, filter standards for density measurement can be provided for red-green-blue filters in various bandwidth and shapes, such as Status T, Status E, DIN, etc. In one exemplary embodiment, if filter standard system 202 is being implemented in North America, the Status T filter standard would be used, as it has been adopted as the densitometry standard for graphics arts in North America. The Status T filter standard employs three wide-band filters. The measurements are a triplet of red density, green density, and blue density. The red density is most sensitive to the cyan patches, green density for magenta patches, and blue density for yellow patches. As a result, only one reading needs to be stored for each of the color patches, since the characterization chart contains only cyan, magenta, and yellow patches in various dot activations. Filter standard system 202 thus provides standardized data for a sample, such as an expected density value for the sample.

Color density measurement system 204 performs color density measurements of samples. In one exemplary embodiment, color density measurement system 204 is used to provide a camera that is being calibrated with one or more sample colors for measurement, where each sample has a known color density measured in accordance with one or more color standards. The known color density can be stored on the sample, can be stored in filter standard system 202 and associated with an identifier for the sample, or can be provided in other suitable manners. Color density measurement system 204 then receives the data generated by the camera and generates a color density measurement. This color density measurement can then be compared with filter standard system 202 data or other suitable data.

Camera filter correction system 206 is used to generate correction factors for a camera so that it can perform repeatable measurements with other calibrated cameras. In one exemplary embodiment, camera filter correction system 206 receives filter standard data from filter standard system 202 and color density measurement data from color density measurement system 204 and determines whether there is a difference. For example, if a cyan sample is being measured and a filter standard system 202 provides the value of 255 for the pixel brightness, and a camera being calibrating provides 248, then the difference can be due to a difference in the spectral power distribution of the light illumination source or the spectral response of the camera filter elements. Camera filter correction system 206 generates a correction factor so that the colors measured by the camera as corrected by the correction factor matched the colors indicated by filter standard system 202.

Camera data system 208 stores camera correction data from camera filter correction system 206 or other suitable sources and provides the data as needed to allow the calibrated cameras to be used in suitable processes, such as manufacturing processes. In one exemplary embodiment, camera data system 208 can be accessed over a communications medium when a camera is being installed for use, such as by receiving the camera identification number and providing the camera calibration data. Likewise, camera data system 208 can be used to store the calibration data with the camera, on a suitable storage media or in other suitable manners. For example, camera data system 208 can prompt an operator to enter a camera identification number before allowing a manufacturing process to begin, and can then confirm whether the camera has been calibrated within a specified calibration period or after a predetermined event, such as on a daily basis, in response to a change in lighting, or at other suitable times. If so, then the calibration factors can be supplied, otherwise an error message can be generated requesting the user to perform camera calibration or other suitable processes.

In operation, system 200 is used to calibrate a digital video camera for use in color characterization. System 200 compensates for variations in the spectral power distribution of the illumination source, the spectral responsivity of the camera pixels and filters, or other variations that may create differences in colors measured with a camera as compared to the color as measured in accordance with standards and special-function equipment such as colorimeters or spectrophotometers. System 200 thus allows manufacturing processes such as calibration of test equipment, periodic replacement of test equipment, periodic checking of test equipment, or other suitable processes to be performed. Likewise, system 200 allows high speed digital imaging cameras to be used in place of calorimeters or other equipment that provides accurate measurement capabilities but which is more expensive or which takes longer to operate and thus would not be feasible in the manufacturing environment.

Figure 3:
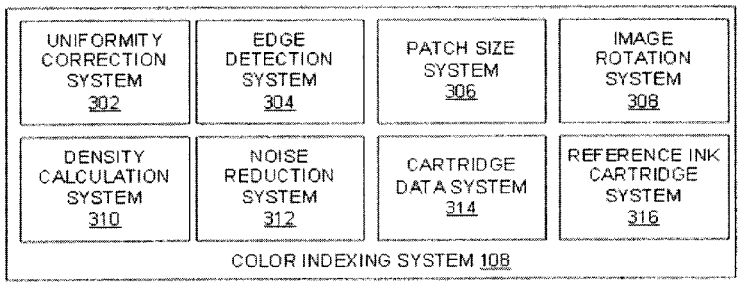
FIG. 3 is diagram of a system for performing color indexing in accordance with an exemplary embodiment of the present invention.

FIG. 3 is diagram of a system 300 for performing color indexing in accordance with an exemplary embodiment of the present invention. System 300 includes color indexing system 108 and uniformity correction system 302, edge detection system 304, patch size system 306, image rotation system 308, density calculation system 310, noise reduction system 312, cartridge data system 314, and reference ink cartridge system 316, each of which can be implemented in hardware, software, or a suitable combination of hardware and software, and which can be one or more software systems operating on a general purpose processing platform.

Uniformity correction system 302 can correct non-uniformity due to lighting of a color sample. In one exemplary embodiment, the following equations can be applied to perform this correction:

$G_d(x,y,)$=dark field with lens capped $G_w(x,y,)$=white field with the blank paper; and $$P_p(x,y)=[P(x,y)-G_d(x,y,)]/[G_w(x,y,)-G_d(x,y,)]$$

where $P_p(x,y)$ is the corrected image pixel for a given image pixel $P(x,y)$.

This correction factor thus compensates for changes in brightness so that consistent measurements can be taken regardless of the illumination of the sample.

Edge detection system 304 locates color calibration patches such that color values can be calculated for each patch. In one exemplary embodiment, edge detection system 304 locates the upper, lower, left, and right bounds and then the pixel locations of the four corners located in the upper bound and the lower bound. In this exemplary embodiment, the image is scanned from the top down on the center pixel column until a vertical grade is detected (i.e., a substantial difference between two adjacent vertical pixels). When the test color patch includes a row of red, then green, and then blue pixels, the upper bound can be located when there is a red vertical gradient is detected (red is the complimentary channel of cyan). Similarly, the lower bound can be found with the scan line from the bottom up when a blue vertical gradient is detected (blue is the complimentary channel of yellow). Several columns of pixels can be averaged so as to obtain a better signal/noise ratio.

Edge detection system 304 can also be used to locate the left and right bounds by scanning the image from left to right on the center row to detect a horizontal gradient (i.e., a substantial difference between two neighboring horizontal pixels). When the test color patch includes a first patch having 100% dot activation for indexing, and a last patch having 100% dot activation for color characterization, the left bound can be found when a green horizontal gradient is detected (green is the complimentary color channel of magenta). A similar process can be used scanning from right to left to detect the right bound. Several rows of pixels can also be averaged so as to obtain a better signal/noise ratio.

Edge detection system 304 can also be used to locate the corner pixels by testing the pixel values around the upper left corner in the neighborhood determined by the intersection of the upper bound and left bound to determine the coordinates of the exact upper left corner pixel, and by repeating this process to determine the coordinates of the pixels for the rest of the corners.

Patch size system 306 calculates the patch size based on predetermined patch characteristics, such as patch numbers, patch sizes, and other patch criteria. For example, if twenty-one patches are used ranging from zero to one hundred percent in five percent increments, then the patch size system 306 can generate patch coordinate data based on this predetermined patch criteria data. Likewise, patch size system 306 can prompt the user to enter the number of patches, can prompt the user to confirm the identify patches and data, or can perform other suitable processes.

Image rotation system 308 determines whether image data defining a color test patch needs to be rotated. For example, since the amount of angular correction is small in most cases, the amount of rotation can be approximated by the number of rows of pixels between the corner coordinates for the four patch corner coordinates. For example, if the top two corners have coordinates of (X1,0) and (X2,-3), an angle of rotation $\Theta$ can be approximated as $\Delta Y/\Delta X$, or $-3/(X2-X1)$. Image rotation can then be performed by the following manner. For each row, detect the left bound as the origin, locate each pixel on the row to be rotated.

$$X'=X\cos\Theta+Y\sin\Theta$$

$$Y'=-X\sin\Theta+Y\cos\Theta$$

The second terms are zero if the first pixel of each row is the origin. Each rotated image point P(X', Y') can thus be determined.

Density calculation system 310 calculates the pixel image data density of each patch. In one exemplary embodiment, the following equation can be used:

$$D=\log10(P_{AVG}/255)$$

where $P_{AVG}$ is the average color pixel value of a given patch. Likewise, other suitable statistical data can also or alternatively be calculated.

Noise reduction system 312 can be used to improve the signal to noise ratio, such as by averaging the pixels of each patch. Furthermore, as the image data values of the pixels along the border of each patch can be degraded due to various factors, such as the modular transfer function of the optical system of the camera, the resolution of the printer, and the number of the elements of the CCD imager, a number of bordering pixels can also be excluded in the calculation of the patch image data density values. Noise reduction system 312 can also check the linearity of the camera against Commission Internationale de l'Eclairage (International Commission on Illumination or CIE) XYZ tristimulus values with the twenty-four step gray wedge on the R1200008 Kodak Q60 Target (sRGB) target. The camera's RGB readings can be linearized with the following equation $$R'=R*Y/Y_n$$

where

R' is the linearized red value

R is the original red values

Y is the corresponding tristimulus Y value, and $Y_n$ is the Y value of the blank media Similar equations can be used to linearize green and blue values.

Cartridge data system 314 receives specimen ink cartridge color density characterization data, specimen ink cartridge identification data, specimen ink cartridge type data, and other suitable data and stores the data in a relational database. In addition, cartridge data system 314 provides the data upon demand, such as when specimen ink cartridge identification data is provided by a user when the specimen ink cartridge is being installed. Other suitable processes can also or alternatively be used, such as storing the specimen ink cartridge data in a data storage device of the specimen ink cartridge.

Reference ink cartridge system 316 receives reference ink cartridge color density characterization data, reference ink cartridge type data, and other suitable data and stores the data in a relational database. In addition, reference ink cartridge system 316 provides the data upon demand, such as when specimen ink cartridge identification data is provided by a user when the specimen ink cartridge is being installed, and specimen ink cartridge type data is used to correlate the specimen ink cartridge to a reference ink cartridge. Other suitable processes can also or alternatively be used, such as storing the reference ink cartridge data in a data storage device of the specimen ink cartridge.

In operation, system 300 allows color density data to be generated for use with reference ink cartridge color characterization data, specimen ink cartridge color patch, or other suitable data, and allows the specimen ink cartridge data and the reference ink cartridge data to be provided for use in controlling the specimen ink cartridge color. System 300 thus facilitates the generation of reference ink cartridge color characterization data and specimen ink cartridge color characterization data for color characterization and control.

Figure 4:
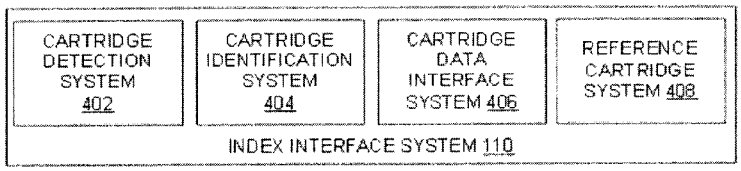
FIG. 4 is a diagram of a system for index interfacing in accordance with an exemplary embodiment of the present invention.

FIG. 4 is a diagram of a system 400 for index interfacing in accordance with an exemplary embodiment of the present invention. System 400 includes index interface system 110 and cartridge detection system 402, cartridge identification system 404, cartridge data interface system 406, and reference cartridge system 408, each of which can be implemented in hardware, software, or a suitable combination of hardware and software, and which can be one or more software systems operating on a general purpose processing platform.

Cartridge detection system 402 generates cartridge replacement data. In one exemplary embodiment, cartridge detection system 402 can detect whether an ink cartridge is present in a carriage, and can generate query data or other suitable data if it determines that the state of the carriage has gone from occupied to unoccupied or has otherwise changed in a manner that indicates that the cartridge is being replaced. In one exemplary embodiment, cartridge detection system 402 can generate a query asking the user to indicate whether a new cartridge has been provided. Likewise, cartridge detection system 402 can automatically detect the cartridge, such as by reading a cartridge identifier from a data memory device of the cartridge or other suitable devices.

Cartridge identification system 404 works in conjunction with cartridge detection system 402 to obtain cartridge identification data. For example, if cartridge detection system 402 requests the user to indicate whether or not the cartridge has been exchanged, then cartridge identification system 404 can subsequently prompt the user to provide the cartridge identifier if the user indicates that the cartridge has been changed. Likewise, cartridge identification system 404 can read cartridge data using optical imaging or by other suitable processes.

Cartridge data interface system 406 receives cartridge data for processing. In one exemplary embodiment, cartridge data interface system 406 can initiate an Internet connection, using existing Internet connection, initiate a telephone connection, or use other suitable processes to access a website, IRC site, or other suitable locations at which cartridge characterization data is stored for a cartridge. The cartridge data can include color density data, color characterization data, reference cartridge data, non-functional nozzle identification data, nozzle correction pattern data, nozzle control sequence data, or other suitable data.

Reference cartridge system 408 stores color characterization data for a reference ink cartridge. In one exemplary embodiment, reference cartridge system 408 can receive reference ink cartridge data from a manufacturer or other suitable sources, can allow a user to create a reference ink cartridge by using one or more calibrated cartridges, or can perform other suitable functions.

In operation, system 400 allows a remote processor to access specimen ink cartridge data, reference ink cartridge data, and other suitable data for use in generating color characterization and control data. System 400 allows such processes to be performed automatically, with user intervention, or in other suitable manners.

Figure 5:
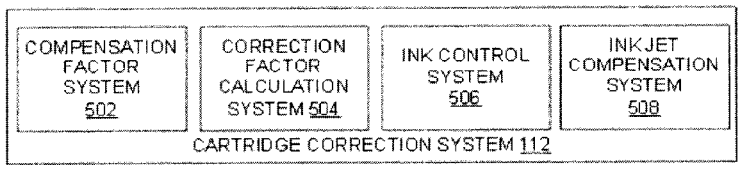
FIG. 5 is a diagram of a system for controlling a color cartridge in accordance with an exemplary embodiment of the present invention.

FIG. 5 is a diagram of a system 500 for controlling a color cartridge in accordance with an exemplary embodiment of the present invention. System 500 includes cartridge correction system 112 and compensation factor system 502, correction factor calculation system 504, ink control system 506, and ink jet compensation system 508, each of which can be implemented in hardware, software, or a suitable combination of hardware and software, and which can be one or more software systems operating on a general purpose processing platform.

Compensation factor system 502 provides a compensation factor for use in determining a correction factor. In one exemplary embodiment, when a correction factor is calculated, an empirical compensation factor can also be applied where it has been determined that using the calculated compensation factor either over compensates or under compensates. For example, if a reference ink cartridge color density for a pre-determined dot activation is 100% and the specimen ink cartridge color density for that dot activation is 90%, then the specimen ink cartridge dot activation would need to be increased so as to provide more ink to generate the 1.0 color density. In this example, it might be determined that the specimen ink cartridge generates the 1.0 color density with a dot activation of 90. However, when 90 percent is used for the specimen ink cartridge, the color density realized in operation might be 0.9. Compensation factor system 502 can be used to adjust the dot activation from 90 percent to a value higher than 90 percent, such as one that is empirically determined.

Correction factor calculation system 504 generates a correction factor for use in correcting and controlling color. In one exemplary embodiment, correction factor calculation system 504 receives a specimen ink cartridge color density function and a reference ink cartridge color density function and maps the specimen ink cartridge to the reference ink cartridge. For example, if the reference ink cartridge color density for a dot activation is X and the specimen color density is Y, then a correction factor of X–Y is required. However, if the specimen ink cartridge dot activation is corrected to provide the full X–Y correction, then it may be determined that the correction overcompensates the amount of color, such that a correction factor of less than X–Y is desirable, as described above. Thus, correction factor calculation system 504 can calculate a theoretical correction factor, an actual correction factor using compensation factor system 502 or other suitable correction factors.

Ink control system 506 receives the correction factor generated by correction factor calculation system 504 and generates printing control data so as to generate accurate colors. In one exemplary embodiment, ink control system 506 can receive color density curve coefficients generated by curve fitting the specimen ink cartridge data on to the reference ink cartridge data, can generate a look-up table with 256 or 4096 data points, or can use other suitable processes to generate printing control data. For example, for a color density of D1, the reference ink cartridge data may indicate that a dot activation of N1 needs to be generated, but the mapped specimen ink cartridge data may indicate that a dot activation of N2 needs to be provided. Furthermore, after applying a correction factor, it may be determined that a dot activation of N3 is actually required. Ink control system 506 receives the values of N1 and maps them to values of N2 or N3, as appropriate.

In another exemplary embodiment, ink control system 506 can receive nozzle correction pattern data or nozzle control sequence data and can modify printer control data that is generated for an ink cartridge with a fully-functional set of ink jet nozzles, so as to generate printer control data for an ink jet cartridge with non-functional ink jet nozzles. In this exemplary embodiment, ink control system 506 can interface with ink jet compensation system 508, data storage devices, or other suitable systems or devices to receive nozzle correction pattern data and nozzle control sequence data for an ink cartridge having one or more non-functional ink jet nozzles. In another exemplary embodiment, ink control system 506 can receive one or more characteristic equations that define alternate nozzle correction patterns and alternate nozzle control sequences as a function of non-functional ink jet nozzle identification data, and can generate printer control data based upon the failed non-functional ink jet nozzle identification data and such characteristic equations.

Ink jet compensation system 508 receives ink cartridge identification data and retrieves non-functional ink jet nozzle data. In one exemplary embodiment, ink jet compensation system 508 can interface with index interface system 110 or other suitable systems to retrieve non-functional ink jet nozzle data from a remote location. Likewise, ink jet compensation system 508 can interface with a data storage device of the ink cartridge, which can include non-functional ink jet nozzle identification data. In another exemplary embodiment, ink jet compensation system 508 can query one or more devices on an ink cartridge that provide non-functional ink jet nozzle data and can use the non-functional ink jet nozzle identification data to obtain nozzle correction pattern data and nozzle control sequence data. In this exemplary embodiment, ink jet compensation system 508 can interface through a communications medium with a remote data storage location, can generate files of correction pattern data and nozzle control sequence data from characteristic equations, can retrieve nozzle correction pattern data and nozzle control sequence data from a local database, can retrieve the nozzle correction pattern data and nozzle control sequence data instead of determining the non-functional ink jet nozzles, or can perform other suitable functions.

In operation, system 500 performs color correction for specimen ink cartridges. System 500 receives specimen ink cartridge data, reference ink cartridge data, compensation factor data, or other suitable data, and determines the percentage of dots to fire for a desired color density. System 500 thus can be used to insure that the colors generated are representative of colors that would be generated by a standardized process.

FIG. 6 is a flowchart of a method 600 for providing compensation for non-functional ink cartridge ink jet nozzles in accordance with an exemplary embodiment of the present invention. Method 600 allows ink jet cartridges with non-functional ink jet nozzles to be used in a manner that does not noticeably impair the image data generated using the ink cartridge.

Method 600 begins at 602 where a camera is calibrated. In one exemplary embodiment, camera calibration can be performed using camera calibration procedures specified by one or more industry standards, camera calibration procedures used to allow non-specialized cameras to measure color density, or other suitable camera calibration procedures. The method then proceeds to 604.

At 604 a test pattern is printed. In one exemplary embodiment, the test pattern can be developed to identify one or more non-functional ink jet nozzles. This test pattern can include one or more patches in which varying numbers and configurations of ink jet nozzles are activated, so as to allow the image data to be analyzed to identify non-functional ink jet nozzles. The method then proceeds to 606.

At 606, the ink jet nozzle operability data is determined by analyzing the image data. In one exemplary embodiment, the image data generated can be analyzed using a suitable procedure, such as comparison to a reference image, histographic analysis of the image data after processing with one or more templates, or other suitable data. For example, the image data can include an N×M pixel array that has been indexed to a reference point, and a template can be applied to block image data for predetermined pixel locations, where such pixel locations correspond to inactive or non-activated ink jet nozzles. In this exemplary embodiment, a histogram of image data that has been processed using the template should indicate a high frequency of pixels at locations having brightness values indicative of functional ink jet nozzles. If brightness values indicative of non-functional ink jet values are detected, additional test patterns can be printed. Likewise, other suitable processes can be used. The method then proceeds to 608.

At 608, ink jet nozzle data is stored. In one exemplary embodiment, the ink jet nozzle data can include one or more arrays of non-functional ink jet nozzles, nozzle correction pattern data determined from a local database based on the non-functional ink jet nozzle data, nozzle control sequence data from a local database, or other suitable data. The method then proceeds to 610.

At 610, the ink cartridge is shipped. In one exemplary embodiment, cartridge identification data can be stored in addition with non-functional ink jet nozzle identification data, nozzle correction pattern data, nozzle control sequence data, or other suitable data, such as in a data storage device of the ink cartridge, in a database accessible over a communications medium, or in other suitable configurations or using other suitable processes. The method then proceeds to 612.

At 612 the cartridge is installed at an end user location. In one exemplary embodiment, the identity of the end user is unknown until the cartridge is installed. Installation of the cartridge can also activate devices that are used to read data stored on a data storage device of the cartridge, identification data printed on the cartridge, or other suitable processes. The method then proceeds to 614.

At 614 cartridge identification data is determined. In one exemplary embodiment, data read from a data storage device or from markings on the cartridge is analyzed to determine the cartridge identification data. In another exemplary embodiment, the user can be queried to enter cartridge identification data. Other suitable processes can also or alternatively be used. The method then proceeds to 616.

At 616 nozzle operability data is received. In one exemplary embodiment, the nozzle operability data can be a set of non-functional ink jet nozzles, non-functional ink jet nozzle identification data, or other suitable nozzle operability data. The method then proceeds to 618.

At 618 nozzle correction pattern data and nozzle control sequence data is generated. In one exemplary embodiment, the non-functional ink jet nozzle data can be used to access a table of stored values at a remote location or locally, can be used as input to a characteristic equation, or other suitable processes can be used to generate the nozzle correction pattern data and nozzle control sequence data. Likewise, the nozzle correction pattern data and nozzle control sequence data can be provided directly without the intermediate step of providing the non-functional ink jet nozzle data. The method then proceeds to 620.

At 620 the nozzle correction pattern data and nozzle control sequence data is applied to printer control data. In one exemplary embodiment, printer control data can be generated based on a fully functional set of ink jet nozzles, and the printer control data can then be modified to compensate for the non-functional ink jet nozzles. Likewise, the printer control data can be generated using equations or relationships that have been modified to compensate for the one or more non-functional ink jet nozzles, or other suitable processes can be used so as to allow ink cartridges with non-functional ink jets to be used to print image data without detectable changes in image quality.

In operation, method 600 allows non-functional ink jet nozzles to be identified and compensated for, so as to allow ink cartridges that would otherwise include an unacceptable level of non-functional ink jet nozzles to be used without any noticeable degradation in image quality. Method 600 characterizes the number of non-functional ink jet nozzles of an ink cartridge, and then determines nozzle correction pattern data and nozzle control sequence data that can be used to control the ink cartridge so as to generate image data that is not noticeably different to an observer from image data generated using an ink cartridge with a full set of functional ink jet nozzles.

FIG. 7 is a flowchart of a method 700 for generating nozzle correction pattern data and nozzle control sequence data in accordance with an exemplary embodiment of the present invention. Method 700 begins at 702 where nozzle correction patterns are mapped. In one exemplary embodiment, a plurality of nozzle correction patterns can be generated for an ink cartridge, such as nozzle correction patterns where one or more ink jet nozzles adjacent to one or more non-functional ink jet nozzle are activated to compensate for the non-functional ink jet nozzles, patterns where one or more functional ink jet nozzles are fired at a location to compensate for one or more non-functional ink jet nozzles, or other suitable patterns. In one exemplary embodiment, an N×M array of ink jet nozzles can be used, where the ink jet nozzle at coordinate location (1,1) has failed. Nozzle correction patterns can be generated where the ink jet nozzle at coordinates (1,2), (2,2) and (2,1) are generated, so that the image data can be compared to a reference image, so that color density data can be generated, or so that other suitable processes can be performed. In this exemplary embodiment, the printer head can be activated at predetermined levels of percent of ink jet nozzles activated, such as 10%, 20%, and so forth up to 100%. The nozzle correction patterns can be generated for each level using the replacement nozzles, or data can be generated to indicate that the replacement nozzle for that configuration would normally be activated. For example, where ink jet nozzle (1,1) has failed, and 100% of nozzles are to be activated, it could be determined that each of the ink jet nozzles at coordinate locations (1,2), (2,2), and (2,1) are required for 100% activation, such that none of these adjacent ink jet nozzles are available to replace the non-functional ink jet nozzle. In this exemplary embodiment, data can be generated indicating that there are no available replacement nozzles for a nozzle correction pattern. Likewise, other suitable ink jet nozzle failure conditions, replacement ink jet nozzle conditions, and replacement nozzle data can be generated. The method then proceeds to 704.

At 704 nozzle control sequences are mapped. In one exemplary embodiment, an ink jet cartridge can be used to generate image data in a series of passes, where a first set of ink jet nozzles are activated when the ink cartridge is moved from left to right and a second set of ink jet nozzles is activated when the ink cartridge is moved from right to left. Likewise, as the ink cartridge advances line by line, there may be some overlap, such that a given point may be exposed to two or more rows of ink jet nozzles. For example, with an M×N array of ink jet nozzles, a point on a page may be capable of being sprayed by ink from an ink jet nozzle at coordinate (1,1) during a first pass of the ink cartridge from left to right, and at the same coordinate during the return pass of the ink cartridge from right to left. The ink cartridge may then subsequently advance one-half of a line, such that the ink cartridge now can spray ink at the location covered by the failed nozzle using an ink jet nozzle having coordinates (1,X), where $M<X<N$. In this manner, a nozzle control sequence can be determined that allows a point to be sprayed with ink at a different point in the printing process, such as at a first forward or reverse pattern, a second forward or reverse pattern, or other available forward or reverse patterns. Thus, if a nozzle correction pattern is not available that would allow that location to be sprayed with ink, a nozzle control sequence might be able to allow that location to be sprayed. After all nozzle control sequences have been generated the method then proceeds to 706.

At 706, interchangeability of nozzle correction patterns and nozzle control sequences is determined. In one exemplary embodiment, the set of nozzle correction pattern test data and nozzle control sequence test data can be compared with reference images, where difference image data is generated and analyzed to determine whether the difference between the reference image and the test image data exceeds predetermined threshold levels. For example, histogram analysis, image data grouping analysis, or other suitable processes can be used to determine whether the differences between the generated test image and the reference image would be able to be noticeable to an observer. The method then proceeds to 708.

At 708 nozzle correction patterns and nozzle control sequences are stored that can be used to replace non-functional ink jet nozzles without creating a noticeable difference between image data generated using a full set of functional ink jet nozzles. In one exemplary embodiment, the nozzle correction pattern data and the nozzle control sequence data is stored in a database cross-referenced with non-functional ink jet nozzle data, such that for a given set of non-functional ink jet nozzle data, a corresponding nozzle correction pattern data set or nozzle control sequence data set can be retrieved. Likewise, if a nozzle correction pattern data sequence is available and a nozzle control sequence data pattern set is available, a preference for one or the other could be used, such as where implementation of a nozzle correction pattern is easier than implementation of a nozzle control sequence. Likewise, other suitable processes can be used.

In operation, method 700 allows one or more sets of nozzle correction pattern data and nozzle control sequence data to be generated to compensate for non-functional ink jet nozzles. Method 700 thus allows the production yield for ink jet cartridges to be increased, by allowing ink jet cartridges that would otherwise be considered unusable to be used, such as by compensating for non-functional ink jet nozzles through activation of other equivalent ink jet nozzles or by activation of ink jet nozzles in previous or subsequent printer head passes, such as where such other nozzles can print at the location where the non-functional ink jet nozzles would have printed.

Figure 8:
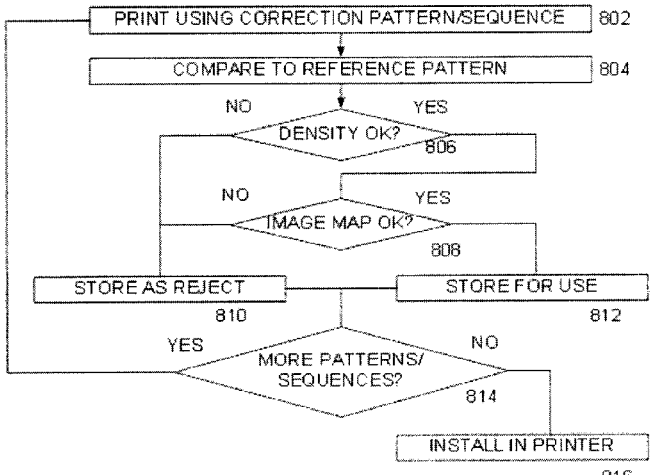
FIG. 8 is a flowchart of a method for determining whether a nozzle correction pattern or nozzle control sequence for a non-functioning ink jet nozzle is acceptable in accordance with an exemplary embodiment of the present invention.

FIG. 8 is a flowchart of a method 800 for determining whether a nozzle correction pattern or nozzle control sequence for a non-functioning ink jet nozzle is acceptable in accordance with an exemplary embodiment of the present invention. Method 800 begins at 802 where a correction pattern or sequence is used to print a test image. In one exemplary embodiment, a series of test patches can be generated using different nozzle correction patterns and nozzle control sequences, and a set of acceptable nozzle correction patterns and nozzle control sequences can be identified. The method then proceeds to 804.

At 804 the test images are compared to a reference pattern, such as one generated using an ink cartridge with fully functional ink jet nozzles. Likewise, the nozzle correction patterns and nozzle control sequences generated at 802 can include varying degrees of ink jet nozzle activation, such as in 10% increments (e.g., from 0% of nozzles activated to 100% of nozzles activated in 10% nozzle activation steps), for predetermined patterns in which the non-functioning ink jet nozzle would be activated, or in other suitable manners.

At 806 it is determined whether the density of each test image is acceptable. For example, the color density of a test image can be determined using a calibrated image data measurement device, and then can be compared to the color density measured for the reference image. If it is determined that the color density is not acceptable the method proceeds to 810. Otherwise the method proceeds to 808.

At 808 it is determined whether the image map is acceptable. In one exemplary embodiment, the test image may generate image data that is noticeably different from the reference image data. For example, benchmark data sets or templates can be used based on differences that were observable to a population of observers, and these benchmarks can be applied to the test image data to determine whether the differences between the reference image and the test image would be noticeable to observers. Likewise, a population of observers can also be used to make subjective determinations, or other suitable procedures can be used. If it is determined that the image map is not acceptable the method proceeds to 810 and the nozzle correction pattern or nozzle control sequence that was used to generate that test image data is rejected. Otherwise, the method proceeds to 812 and the nozzle correction pattern or nozzle control sequence that was used to generate that test image data is stored for use. The method then proceeds to 814.

At 814 it is determined whether additional nozzle correction patterns or nozzle control sequences need to be analyzed. For example, a set of nozzle correction patterns or nozzle control sequences can be generated for each ink jet nozzle in the ink jet nozzle array, for combinations of two ink jet nozzles in the ink jet nozzle array, and so forth until all acceptable nozzle failure combinations have been identified. For example, in an N×M ink jet nozzle array, it can be determined that a set of X failed nozzles is acceptable if certain degrees of separation exists between each of the X nozzles, such as one row of separation, one column of separation, one row and one column of separation, or other suitable metrics. Likewise, it can also be determined that two or more adjacent nozzles out of the set of X non-functioning ink jet nozzles is acceptable, as long as there are predetermined degrees of separation between such adjacent non-functioning ink jet nozzles and all other non-functioning ink jet nozzles. Likewise, other suitable parametric equations can be determined, where the parametric equation can be used to determine nozzle correction patterns or nozzle control sequences based on an input set of non-functioning ink jet nozzles. Once it is determined that there are no more nozzle correction patterns or nozzle control sequences for which acceptable alternate ink jet nozzles exist, the method proceeds to 816 where the nozzle correction patterns or nozzle control sequences are installed in a printer, such as when the printer driver is activated, by transmitting them over a communications medium when the ink cartridge is installed in the printer, or in other suitable manners. Otherwise, the method returns to 802.

In operation, method 800 allows nozzle correction patterns and nozzle control sequences to be tested to determine whether images generated using those nozzle correction patterns or nozzle control sequences are suitable replacement images for image data generated using fully functional nozzles. Method 800 allows a set of non-functional ink jet nozzles to be tested to determine whether other functional ink jet nozzles can be used to compensate for the non-functional nozzles.

Figure 9:
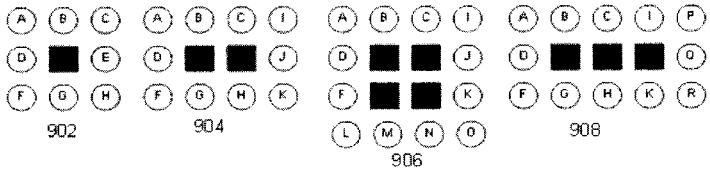
FIG. 9 is a diagram of non-functional ink jet nozzle patterns in accordance with an exemplary embodiment of the present invention.

FIG. 9 is a diagram 900 of non-functional ink jet nozzle patterns in accordance with an exemplary embodiment of the present invention. The non-functioning ink jet nozzle patterns include [3×3] array 902, [3×4] array 904, [4×4] array 906, and [3×5] array 908, in which the non-functioning nozzle location is shown as a darkened square and the functioning nozzle locations are shown as circles with associated letters. For ink jet nozzle array 902, any of functioning ink jet nozzles A through H can be used in place of the non-functioning nozzle. Thus, if a nozzle correction pattern can be used for every print location, a nozzle control sequence might not be necessary to compensate for the non-functioning ink jet nozzle shown in nozzle array 902. For example, the ink jet nozzles in rows [A, B, C] and [F, G, H] can be used to print when the ink jet head is traversing from left to right, whereas the row containing the non-functioning ink jet nozzle and functioning ink jet nozzles D and E could be used to print when the ink jet head is traversing from right to left. In this exemplary embodiment, using ink jet B or G in place of the failed ink jet nozzle might be acceptable and not cause damage to ink jet nozzles B and G if they are alternated. Likewise, if ink jet nozzles A, C, F and H are used in one direction and D, B, E and G are used in a different direction, it may be possible to alternate the use of ink jet nozzles to compensate for the non-functioning ink jet nozzle. Whether or not such alternate nozzles could be used can be determined empirically, based on an analysis of image data generated for test images as compared to reference images, or in other suitable manners.

Likewise, for ink jet nozzle array 904, the combination of two adjacent failed nonfunctioning ink jet nozzles can require a combination of ink jet nozzles to be used such as nozzles B and H, G and C, D and J, F and I, K and A, or other suitable combinations. Depending on the availability of such other ink jet nozzles for every possible combination of ink jet nozzle activation, an ink cartridge that includes ink jet nozzle array 904 may not have a nozzle correction pattern that can be used. Nevertheless, it is likewise possible that two functioning ink jet nozzles could be placed over the location where the two failed ink jet nozzles should be activated, such that in a first pass, ink jet nozzle array 904 is used and the two non-functioning nozzle points are noted, and in the next subsequent pass, two functioning ink jet nozzles that are placed over the location where the two non-functioning ink jet nozzles from ink jet nozzle array 904 would have been. The two functioning nozzles can then be activated, so as to produce image data having the same visual qualities to an observer. Thus, a nozzle control sequence can be used in addition to or instead of a nozzle correction pattern to compensate for the two non-functioning ink jet nozzles.

Ink jet nozzle array 906 shows four adjacent non-functioning ink jet nozzles, such that the number of functioning ink jet nozzles that are available to replace each non-functioning ink jet nozzles has decreased. For example, in ink jet nozzle array 902, the one non-functioning ink jet nozzle has eight available ink jet nozzles to replace it. Likewise, in ink jet nozzle array 904, each non-functioning ink jet nozzle has five functioning ink jet nozzles that could be used to replace it. In ink jet nozzle array 906, each non-functioning ink jet nozzle has only three adjacent functioning ink jet nozzles that can be used to generate a nozzle correction pattern. Thus, ink jet nozzle array 906 can be indicative of a non-functioning ink jet nozzle arrangement that can be corrected only by a nozzle control sequence, only by a nozzle correction pattern, by either a nozzle control sequence or nozzle correction pattern, or which cannot be corrected based on the location of other non-functioning ink jet nozzles in the ink jet cartridge printer head. Likewise, ink jet nozzle array 908 provides five functioning ink jet nozzles to replace the two non-functioning ink jet nozzles on either end of the three adjacent non-functioning ink jet nozzles, and between two adjacent ink jet nozzles for the middle non-functioning ink jet nozzle.

In operation, ink jet nozzle arrays 900 demonstrate ink jet nozzle configurations in which non-functional ink jet nozzles can be replaced with functional ink jet nozzles.

Depending on the order in which adjacent ink jet nozzles are fired, nozzle correction patterns, nozzle control sequences, or a suitable combination of both can be used to compensate for non-functional ink jet nozzles.

Figure 10:
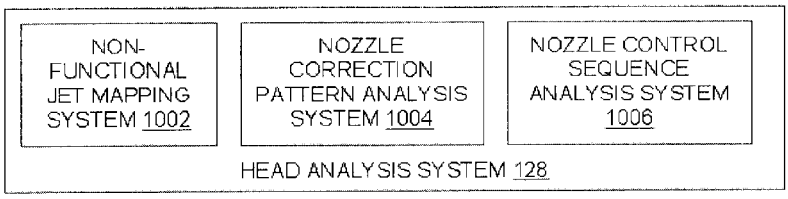
FIG. 10 is a diagram of a system for providing ink jet head analysis in accordance with an exemplary embodiment of the present invention.

FIG. 10 is a diagram of system 1000 for providing ink jet head analysis in accordance with an exemplary embodiment of the present invention. System 1000 includes head analysis system 130 and non-functional jet mapping system 1002, nozzle correction pattern analysis system 1004, and nozzle control sequence analysis system 1006, each of which can be implemented in hardware, software, or a suitable combination of hardware and software, and which can be one or more software systems operating on a general purpose processing platform.

Non-functional jet mapping system 1002 analyzes image data to determine the location of one or more non-functioning ink jet nozzles. In one exemplary embodiment, nonfunctional jet mapping system 1002 can use histogram analysis, templates, or other suitable functions to compare test image data with reference image data, or to otherwise analyze test image data to identify the location of one or more non-functioning ink jet nozzles.

Nozzle correction pattern analysis system 1004 generates one or more test images with correction patterns for non-functional ink jet nozzles, and performs additional image data analysis on the one or more test patterns to determine whether they can be used to replace the image data generated by a fully functioning set of nozzles. In one exemplary embodiment, nozzle correction pattern analysis system 1004 can compare a set of nozzle correction patterns to reference image data, and can determine whether the nozzle correction patterns would be noticeably different to a user, have different image color density, or other differences that preclude the use of the nozzle correction pattern. Other suitable processes can also or alternatively be used.

Nozzle control sequence analysis system 1006 determines whether a nozzle control sequence exists for one or more non-functioning ink jet nozzles. In one exemplary embodiment, nozzle control sequence analysis system 1006 determines whether a functioning nozzle arrangement can be used that passes over a location where non-functioning nozzles are depositing ink, such that one or more nozzle control sequences can be used to compensate for the non-functioning ink jet nozzles. Likewise, nozzle control sequence analysis system 1006 can determine whether such use of functioning ink jet nozzles to replace non-functioning ink jet nozzles can result in overuse of the ink jet nozzles, deterioration of the ink jet nozzles before a design life, or whether other suitable problems exist. Other suitable processes can also or alternatively be used.

In operation, system 1000 allows ink jet cartridges to be analyzed to identify ink jet nozzle parameters, such as patterns or sequences, that will allow the non-functioning ink jet nozzles to be compensated for by functioning ink jet nozzles, such as by generation of nozzle correction patterns or nozzle control sequences. System 1000 thus allows ink jet cartridges to be characterized in a manufacturing facility to identify non-functioning ink jet nozzles, and to determine nozzle correction patterns and nozzle control sequences that can be used to allow such ink jet cartridges with non-functioning ink jet nozzles to be used by printers. Other suitable processes can also or alternatively be used.

Figure 11:
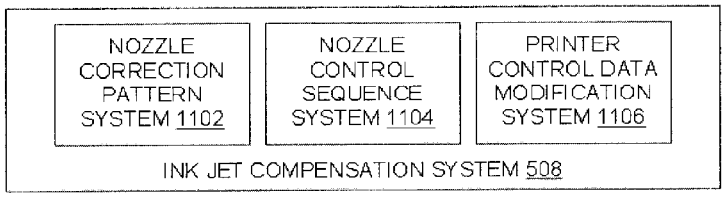
FIG. 11 is a diagram of a system for ink jet nozzle compensation in accordance with an exemplary embodiment of the present invention.

FIG. 11 is a diagram of a system 1100 for ink jet nozzle compensation in accordance with an exemplary embodiment of the present invention. System 1100 includes ink jet compensation system 508 and nozzle correction pattern system 1102, nozzle control sequence system 1104, and printer control data modification system 1106, each of which can be implemented in hardware, software, or a suitable combination of hardware and software, and which can be one or more software systems operating on a general purpose processing platform.

Nozzle correction pattern system 1102 receives non-functioning ink jet nozzle identification data and selects nozzle correction patterns that will allow image data to be generated by an ink cartridge having such non-functioning ink jet nozzles that simulates image data generated by a fully-functional ink cartridge. In one exemplary embodiment, nozzle correction pattern system 1102 includes a lookup table that returns nozzle correction patterns for a given configuration of non-functional ink jet nozzles. In another exemplary embodiment, nozzle correction pattern system 1102 includes one or more characteristic equations that can generate the nozzle correction pattern data in response to non-functioning ink jet nozzle input data. Other suitable processes can also or alternatively be used.

Nozzle control sequence system 1104 receives non-functioning ink jet nozzle identification data and selects nozzle control sequences that will allow image data to be generated by an ink cartridge having such non-functioning ink jet nozzles that simulates image data generated by a fully-functional ink cartridge. In one exemplary embodiment, nozzle control sequence system 1104 includes a lookup table that returns nozzle control sequences for a given configuration of non-functional ink jet nozzles. In another exemplary embodiment, nozzle control sequence system 1104 includes one or more characteristic equations that can generate the nozzle control sequence data in response to non-functioning ink jet nozzle input data. Other suitable processes can also or alternatively be used.

Printer control data modification system 1106 processes printer control data to generate printer control data that can be used for an ink jet cartridge having one or more non-functioning ink jet nozzles. In one exemplary embodiment, printer control data modification system 1106 receives a set of image data and generates printer control data for the ink jet cartridge having non-functioning ink jet nozzles. In another exemplary embodiment, printer control data modification system 1106 receives printer control data generated for image data for an ink jet cartridge having a fully functioning set of ink jet nozzles, and modifies the printer control data to include printer control data for the non-functioning ink jet nozzles. In this manner, printer control data modification system 1106 can be used in conjunction with existing systems, such as printer drivers, can be used to replace such existing systems, or can be used in other suitable configurations.

In operation, system 1100 allows an ink jet having one or more non-functioning ink jet nozzles to be used in a printer, by allowing the non-functioning ink jet nozzles to be compensated for. System 1100 determines whether print patterns can be used to simulate image data for a cartridge with non-functional ink jet nozzles so that it appears to an observer to have been made by a fully functional ink cartridge, or whether printer control data sequences exist that can be used to print at locations where the non-functioning ink jet nozzles would normally print. In this manner, system 1100 allows increased ink cartridge manufacturing yields to be realized by allowing ink cartridges that would otherwise be discarded to be successfully used without any degradation in image quality.

In view of the above detailed description of the present invention and associated drawings, other modifications and variations will now become apparent to those skilled in the art. It should also be apparent that such other modifications and variations may be effected without departing from the spirit and scope of the present invention.

We claim:

1. A system for compensating for non-functional ink cartridge ink jet nozzles comprising:

an ink jet test system generating ink jet activation data;

a head analysis system receiving image data of a test pattern and generating nozzle control data; and wherein the ink jet activation data causes one or more of the ink jet nozzles to activate to form the test pattern.

2. The system of claim 1 wherein the head analysis system further comprises a nozzle correction pattern analysis system receiving the image data and generating nozzle correction pattern data.

3. The system of claim 2 wherein the nozzle correction pattern data further comprises replacement nozzle firing data identifying one or more ink jet nozzles that should be activated instead of a non-functional ink jet nozzle at a predetermined print location.

4. The system of claim 1 wherein the head analysis system further comprises a nozzle control sequence analysis system receiving the image data and generating nozzle control sequence data.

5. The system of claim 4 wherein the nozzle control sequence data further comprises replacement nozzle firing data identifying one or more ink jet nozzles that should be activated to compensate for a non-functional ink jet nozzle in a predetermined print sequence.

6. The system of claim 1 wherein the nozzle control data further comprises nozzle failure data.

7. The system of claim 1 further comprising a cartridge data system storing the nozzle control data with cartridge identification data.

8. The system of claim 1 further comprising a cartridge data system storing the nozzle control data in a data memory of the ink cartridge.

9. The system of claim 1 wherein the a head analysis system further comprises a density calculation system receiving the image data of the test pattern and reference image data and generating color density pass/fail data.

10. A personal computer that compensates for one or more failed ink cartridge ink jet nozzles comprising:

an index interface system retrieving ink jet nozzle failure data;

an ink jet compensation system receiving the ink jet nozzle failure data and generating nozzle correction data; and an ink control system receiving the nozzle correction data and image data and generating printer control data.

11. The personal computer of claim 10 wherein the index interface system retrieves the ink jet nozzle failure data from a data storage device of an ink cartridge.

12. The personal computer of claim 10 wherein the index interface system retrieves the ink jet nozzle failure data from a remote location over a communications medium.

* * * * *